US009007267B2

(12) United States Patent
Man et al.

(10) Patent No.: US 9,007,267 B2
(45) **Date of Patent: *Apr. 14, 2015**

(54) MOBILE WIRELESS COMMUNICATIONS DEVICE HAVING DIVERSITY ANTENNA SYSTEM AND RELATED METHODS

(75) Inventors: Ying Tong Man, Waterloo (CA); Adrian Matthew Cooke, Kitchener (CA); Yihong Qi, Waterloo (CA); Joshua Kwan Ho Wong, Waterloo (CA)

(73) Assignee: BlackBerry Limited, Waterloo, ON (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/610,404

(22) Filed: Sep. 11, 2012

(65) Prior Publication Data

US 2013/0002498 A1 Jan. 3, 2013

Related U.S. Application Data

(63) Continuation of application No. 13/337,353, filed on Dec. 27, 2011, now Pat. No. 8,305,275, which is a continuation of application No. 12/365,908, filed on Feb. 5, 2009, now Pat. No. 8,106,838.

(51) Int. Cl.

| | |
|---|---|
| ***H01Q 9/00*** | (2006.01) |
| ***H01Q 1/24*** | (2006.01) |
| ***H01Q 3/24*** | (2006.01) |

(Continued)

(52) U.S. Cl.

CPC ..... *H01Q 1/243* (2013.01); *H01Q 3/24* (2013.01); *H01Q 5/001* (2013.01); *H01Q 21/30* (2013.01)

(58) Field of Classification Search

USPC ..... 343/702, 853, 861, 876; 455/272–275, 455/101, 575.7

See application file for complete search history.

(56) References Cited

U.S. PATENT DOCUMENTS

| | | | | |
|---|---|---|---|---|
| 5,392,054 | A | 2/1995 | Bottomley et al. | |
| 6,509,883 | B1 * | 1/2003 | Foti et al. | 343/850 |
| 6,771,944 | B2 * | 8/2004 | Harano | 455/276.1 |

(Continued)

FOREIGN PATENT DOCUMENTS

| | | |
|---|---|---|
| EP | 1763152 | 3/2007 |
| WO | 0147126 | 6/2001 |
| WO | 2007025309 | 3/2007 |

*Primary Examiner* — Dameon E Levi
*Assistant Examiner* — Hasan Islam
(74) *Attorney, Agent, or Firm* — Guntin & Gust, PLC; Andrew Gust

(57) ABSTRACT

A mobile wireless communications device has a portable handheld housing. A circuit board is carried by the portable handheld housing. RF circuitry is carried by the circuit board. A diversity antenna and main antenna are carried by the portable handheld housing and coupled to the RF circuitry and operative together. The RF circuitry tunes the diversity antenna into a diversity communications frequency band to achieve a diversity mode of operation with the main antenna and tunes the diversity antenna into a non-diversity communications frequency band when cross-coupling has occurred from the diversity antenna to the main antenna when operating in the diversity communications frequency band. A switch is carried by the portable handheld housing and connected to the RF circuitry and coupled between the diversity and main antennae and disconnects the diversity antenna when operating in the non-diversity band to prevent cross-coupling from the diversity antenna to the main antenna.

23 Claims, 6 Drawing Sheets

(51) Int. Cl.
*H01Q 5/00* (2006.01)
*H01Q 21/30* (2006.01)

(56) References Cited

U.S. PATENT DOCUMENTS 7,126,545 B2 * 10/2006 Nagano et al. ..... 343/702
7,139,533 B2 * 11/2006 Katagishi et al. ..... 455/101
7,353,013 B2 4/2008 Qi et al.
7,369,091 B2 5/2008 Man et al.
7,372,406 B2 * 5/2008 Shiotsu et al. ..... 343/700 MS
7,379,027 B2 5/2008 Kezys et al.
7,405,701 B2 * 7/2008 Ozkar ..... 343/702
7,411,557 B2 * 8/2008 Shimizu et al. ..... 343/702
7,610,070 B2 * 10/2009 Schmidt ..... 455/575.7
7,876,274 B2 * 1/2011 Hobson et al. ..... 343/702
8,106,838 B2 1/2012 Man et al.
8,331,889 B2 * 12/2012 Knudsen et al. ..... 455/217
2005/0136906 A1 6/2005 Azuma
2006/0178116 A1 8/2006 Qi et al.
2007/0052599 A1 * 3/2007 Shimizu et al. ..... 343/702
2008/0007468 A1 * 1/2008 Sato et al. ..... 343/702
2008/0188183 A1 8/2008 Dwyer et al.
2008/0303729 A1 * 12/2008 Milosavljevic et al. ..... 343/722
2009/0295648 A1 * 12/2009 Dorsey et al. ..... 343/702
2010/0194647 A1 8/2010 Man et al.

* cited by examiner

MOBILE WIRELESS COMMUNICATIONS DEVICE HAVING DIVERSITY ANTENNA SYSTEM AND RELATED METHODS

TECHNICAL FIELD

The present disclosure relates to the field of communications devices, and more particularly, to communications devices that use diversity antenna systems.

BACKGROUND

One of the challenges of wireless communications, is designing suitable antennas that provide desired performance characteristics, yet are relatively small in size to fit within mobile devices. For example, with wireless devices such as mobile telephones, it is desirable to maintain the overall size of the telephone as small as possible. Furthermore, internal antennas are generally preferred over external antennas, as externally mounted antennas take up more space and may be damaged while traveling or through other uses.

These wireless devices often operate with cellular communication systems that continue to grow in popularity and have become an integral part of both personal and business communications. Moreover, as cellular telephone technology increases, so too has the functionality of the devices. For example, many portable wireless communications devices now incorporate Personal Digital Assistant (PDA) features such as calendars, address books, task lists, calculators, memo and writing programs. These multi-function devices usually allow users to send and receive electronic mail (email) messages wirelessly and access the internet via a cellular network and/or a wireless local area network (WLAN), for example, when the devices include appropriate circuitry for WiFi and other IEEE 802.11 WLAN access. Many of the cellular communications use packet burst transmissions as part of a Global System for Mobile communications (GSM) system, which includes the 850 MHz, 900 MHz, 1800 MHz and 1900 MHz frequency bands. Although these mobile wireless communication devices function as a cellular telephone, as noted before, the device can also operate and incorporate Personal Digital Assistant (FDA) features and send and receive email and other messages wirelessly and across the internet via the cellular network and/or a wireless Local Area Network (LAN). This function can include access to "hot spots" as part of a WiFi network using IEEE 802.11 standards.

Recent carrier specifications stipulate the addition of diversity antenna in the new generation of wireless mobile communications devices. In order to achieve acceptable diversity performance however, the radiating elements must be electromagnetically isolated. In a mobile wireless communications device having a handheld form factor, achieving adequate isolation often is difficult depending on the specific designs. In some devices, there are two antennae in close proximity to each other that operate in the same frequency spectra (850 and 1900), for example. This configuration results in strong coupling between the two antennae and degrades the radiated performance as they interfere with each other destructively. A possible solution is to tune the destructive interference into another mutually exclusive operating frequency band, which does not require diversity (such as 900 and 1800) or if possible, outside of any operating frequencies. In a multi-band portable wireless communications device, moving the interference into a non-diversity band is insufficient since the interference remains and degrades performance in the non-diversity band.

As an example, in one mobile wireless communications device, diversity is required in the 850 and 1900 bands, but not in the 900 and 1800 bands. Furthermore, the 850 and 1900 bands are mutually exclusive of the 900 and 1800 bands because they do not operate simultaneously. If the interference is tuned to the 900 band, for example, acceptable diversity performance can be achieved. However, the problem may not be solved because if the handheld is operating in the 900 band, the interference could remain. In order to maintain the antenna performance in the 900 band, the diversity antenna should be electromagnetically invisible to the main antenna while operating in the non-diversity bands.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION

Figure 1:
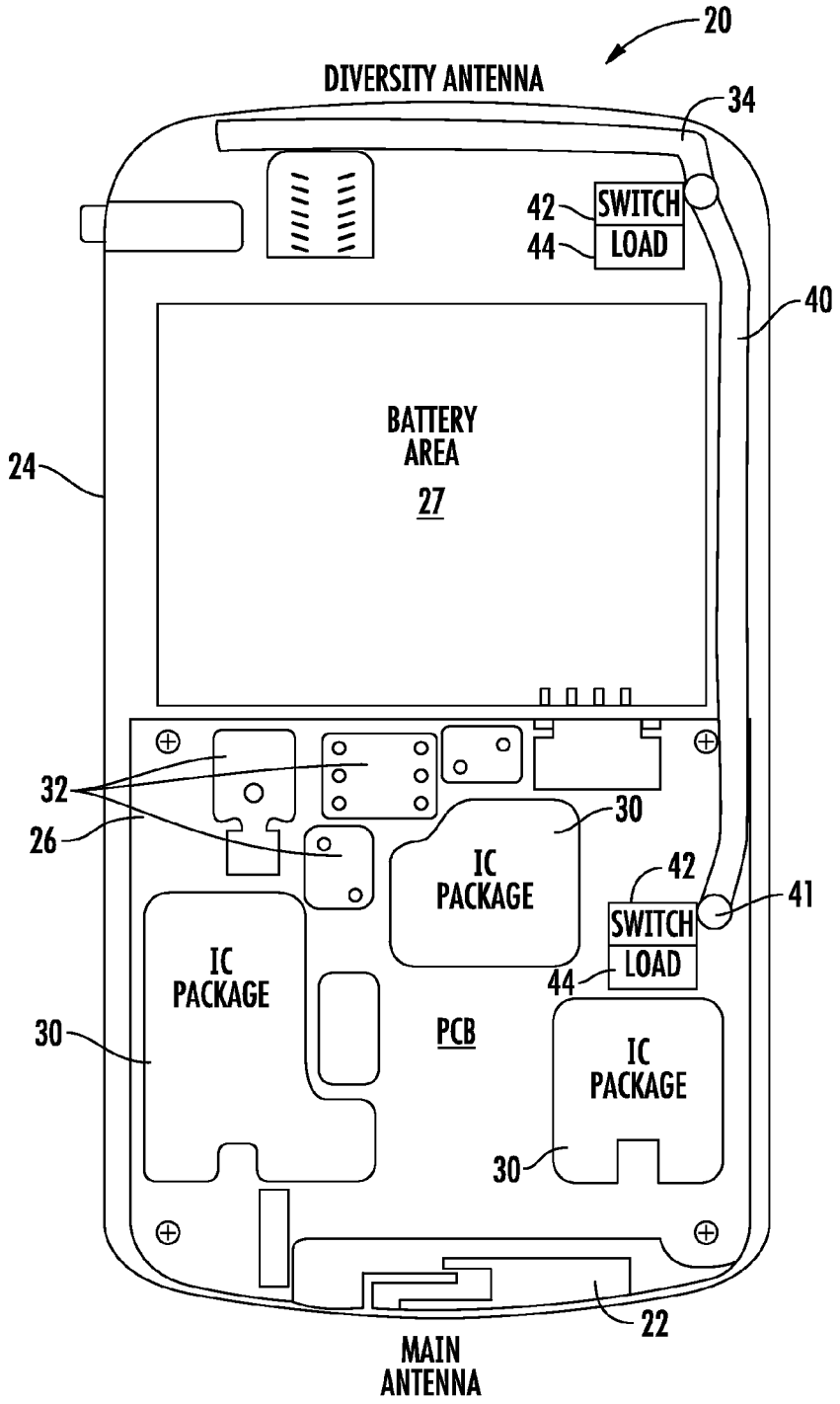
FIG. 1 is a plan view showing the interior of a mobile wireless communications device and showing in greater detail the relative positioning of a main antenna, for example, a cellular antenna and a diversity antenna and showing related internal components.

Different embodiments will now be described more fully hereinafter with reference to the accompanying drawings, in which preferred embodiments are shown. Many different forms can be set forth and described embodiments should not be construed as limited to the embodiments set forth herein. Rather, these embodiments are provided so that this disclosure will be thorough and complete, and will fully convey the scope to those skilled in the art. Like numbers refer to like elements throughout.

A mobile wireless communications device has a portable handheld housing. A circuit board is carried by the portable handheld housing. RF circuitry is carried by the circuit board. A diversity antenna and main antenna are carried by the portable handheld housing and coupled to the RF circuitry and operative together. The RF circuitry tunes the diversity antenna into a diversity communications frequency band to achieve a diversity mode of operation with the main antenna and tunes the diversity antenna into a non-diversity communications frequency band when cross-coupling has occurred from the diversity antenna to the main antenna when operating in the diversity communications frequency band. A switch is carried by the portable handheld housing and connected to the RF circuitry and coupled between the diversity and main antennae and disconnects the diversity antenna when operating in the non-diversity band to prevent cross-coupling from the diversity antenna to the main antenna.

In one non-limiting aspect the portable handheld housing includes an upper and lower portion. The diversity antenna is located at the upper portion of the housing. The main antenna is located at the lower portion of the housing. In another aspect, the diversity antenna is formed from a plurality of antenna elements forming an antenna array. Each antenna element can include a respective switch that is controlled for individually turning ON and OFF selected antenna elements forming the array antenna to change a combined radiation pattern of the array antenna.

In another aspect the circuit board is configured substantially in size to the portable handheld housing. Each antenna element includes a respective switch such that the switch controls its respective antenna element for turning ON and OFF selected antenna elements and changing a combined radiation pattern of the array antenna. In another aspect the circuit board is configured substantially different in size to the portable handheld housing and the main antenna is carried by the circuit board. A cable is connected between the diversity antenna and circuit board and operative with the main antenna. In this example, the switch is located at either the end of the cable connected to the circuit board or at the end of the cable connected to the diversity antenna.

A method aspect is also set forth.

In accordance with non-limiting examples, the diversity antenna can be tuned to produce cross-coupling in a non-diversity mode band. When the mobile wireless communications device is in a non-diversity mode band, the diversity antenna is disconnected from the main antenna (such as a cellular antenna) for example, by using a switch, which disconnects the diversity antenna in the non-diversity bands. The connection becomes open circuit in non-diversity modes. This is useful in cases where the printed circuit board (PCB) is the same size as the housing. In those cases where the printed circuit board is smaller than the housing, a cable typically connects the main and diversity antennae and the switches are placed along the cable.

In one non-limiting example, the switch can also connect the main antenna into a different load in order to impart a different load impedance. This serves to enhance the performance of the main antenna. In these non-limiting examples, the mobile wireless communications device changes the tuning of the antenna to produce cross-coupling on a particular band while also allowing the switch to disconnect the diversity antenna in certain bands where it would produce the cross-coupling with the main antenna.

FIG. 1 shows a top plan view of the interior of a mobile wireless communications device 20 that incorporates a main antenna 22 such as at the bottom of a portable housing 24, which contains a printed circuit board 26 that is smaller than the housing. A battery area 27 provides an area in which a battery is contained. In this example, the main antenna 22 is a cellular antenna and could be positioned on the circuit board 26 or separate. The main antenna 22 could be on a separate board such as an antenna board. The printed circuit board 26 carries various circuit components such as the IC packages illustrated generally at 30 and described further below with reference to FIGS. 5-7 as non-limiting examples. Other electronic components are illustrated generally at 32. The main antenna 22 in this example is a cellular antenna and illustrated at the bottom portion of the housing and typically operative as a multi-frequency antenna. It can have a unique geometric pattern or other configuration. The diversity antenna 34 is positioned at the other end (the top end) of the housing 24. In this particular example, the diversity antenna 34 is connected by a cable 40 to the main antenna 22 through a respective connection point 41 on the circuit board. The cable 40 is used because the printed circuit board 26 is smaller than the housing 24. Switches 42 that are used for disconnecting the diversity antenna 34 from the main antenna 22 are illustrated at possible switch locations are shown in this fragmentary drawing view. Each switch 42 is connected to a load 44.

In this example of a mobile wireless communications device 20, the main antenna 22 is located at the bottom portion of the housing 24 and the diversity antenna 34 at the top portion of the housing. The destructive interferences of the radiated far fields between the diversity antenna 34 and the main antenna 22 are reduced by the use of one or more switches 42, which isolate the diversity antenna 34 from the main antenna 22 by rendering the diversity antenna, as well as any associated feed networks and cables, electromagnetically invisible to the main antenna while operating in the non-diversity bands. The switches 42 also provide a way to change the diversity antenna into different load impedances 44 and thereby potentially enhance the main antenna radiated performance.

For example, a possible switch 42 location is near the printed circuit board 26 or on the printed circuit board connected to the cable 40. The switch 42 in this illustrated example connects into a different load impedance 44 such as a circuit structure contained on the printed circuit board or adjacent the switch at the diversity antenna.

As noted before, the device can have a "chassis" or printed circuit board 26 as roughly the same dimensions as the external housing 24. In that example, a cable typically would not be required to connect with a circuit on the PCB. Another possible configuration is having the chassis or printed circuit board 26 with a significantly different configuration and dimensions as the external housing 24, such as shown in the example of FIG. 1.

The diversity antenna 34 in this example is formed as an array, for example, an adaptive array antenna, which could be a single antenna with active elements or an array of similar or different antennae that could possibly change their combined radiation pattern as different conditions persist, depending on design. These antennae as described can be used both in the transmit and receive configuration.

Figure 2:
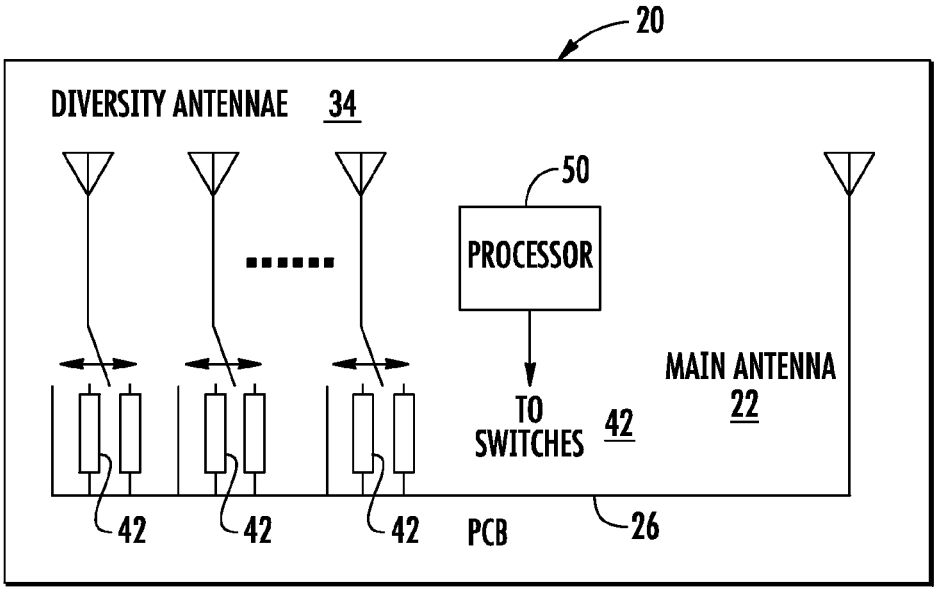
FIG. 2 is a fragmentary view of a mobile wireless communications device and showing the diversity antenna as an antenna array on the printed circuit board (PCB) and the main or cellular antenna and each diversity antenna equipped with a switch.

FIG. 2 is a fragmentary view of the interior of the device 20 with exaggerated dimensions and showing that the printed circuit board 26 has about the same dimensions as the external housing 24. In this particular example, each diversity antenna 34 is equipped with a switch 42 that could be connected to a main processor or other antenna controller shown at 50 that could operate to turn on and off individual antenna elements using the switch. A switch 42 could also be a three-way switch to allow switching into a different load impedance.

Figure 3:
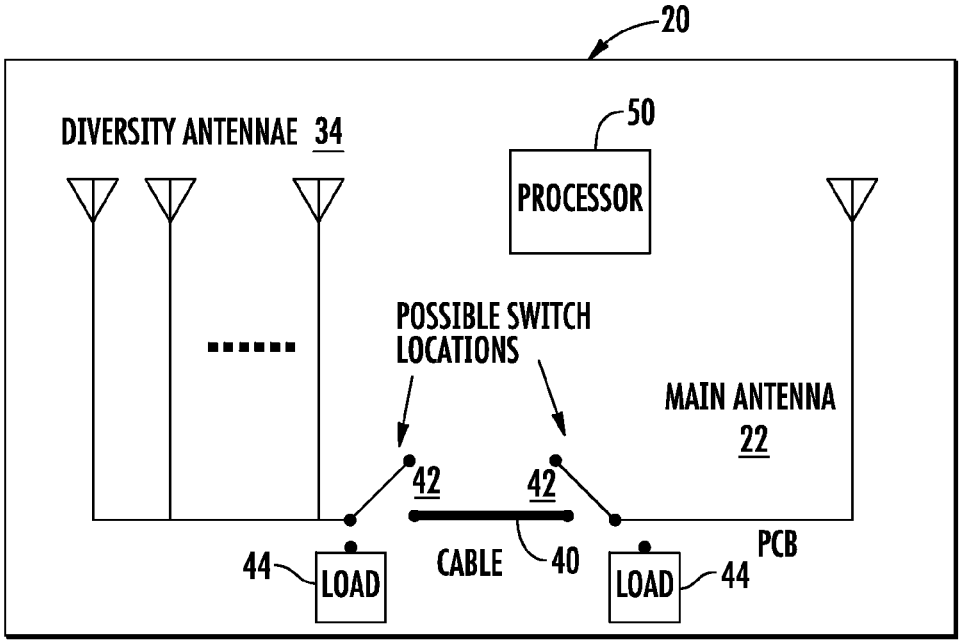
FIG. 3 is another fragmentary view similar to FIG. 2, but showing a mobile wireless communications device in which the printed circuit board is smaller than the housing such as in the example of FIG. 1 and showing a cable connecting the diversity antenna and main antenna with at least one switch placed along the cable.

FIG. 3 is a fragmentary view similar to that shown in FIG. 3 where the printed circuit board 26 dimensions are significantly different from the dimensions of the external housing 24 and the diversity antenna 24 is connected to a circuit trace on the printed circuit board using the cable 40. The switch 42 may be placed at the printed circuit board end of the cable 40 or at the diversity end of the cable as illustrated. Possible physical locations using such a described implementation for FIG. 3 are shown in FIG. 1.

It should be understood that the main antenna 22 and diversity antenna 34, which are illustrated at the respective bottom and top portions of the housing 24 in FIG. 1 could be located at different areas and positions within the mobile wireless communications device. Also, the diversity antenna 34 as an array could have a number of different elements that are located throughout the housing within the device instead of together or adjacent as shown in FIGS. 2 and 3.

Different switch designs can also be used. For example, a microelectromechanical (MEMS) switch could be formed separate or with different components and as a MEMS IC package. When the cable implementation is used such as shown in FIG. 2, a separate MEMS device could be incorporated and connected into the cable assembly. Also a separate MEMS device as a switch could be located on a printed circuit board in either of the configurations shown in FIGS. 2 and 3. Other switch configurations include a separate transistor switch could be used instead of a MEMS switch. Other switches are possible. Three-way switches can be used for switching into a different load impedance.

Figure 4:
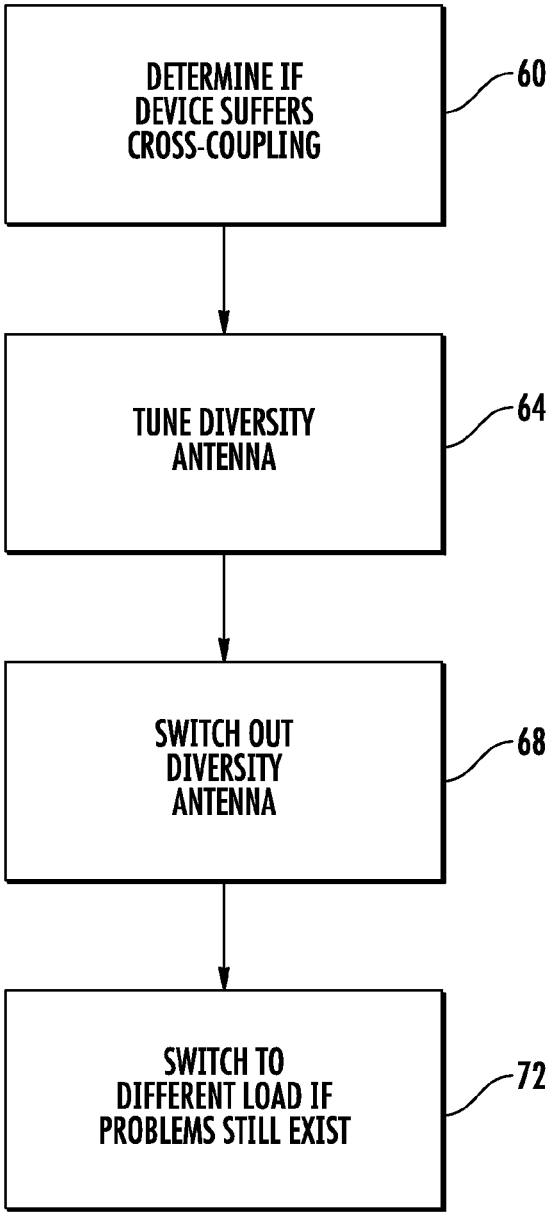
FIG. 4 is a flow diagram illustrating methods of operating the mobile wireless communications device in accordance with a non-limiting aspect using the diversity and main antennae and switches.

FIG. 4 illustrates a flow sequence in accordance with a non-limiting method of operation. Initially, a determination can be made if a problem has arisen when the device is operating and suffers cross-coupling between the diversity antenna and main antenna (Block 60). At this time, the diversity antenna can be tuned in the non-diversity mode band (Block 64). When the device is in the non-diversity mode band, the system disconnects the diversity antenna from the antenna using the switch (Block 68). If possible problems still exist, the system can switch the antenna to a different load (to a different load impedance), which enhances the performance of the main antenna (Block 72).

Figure 5:
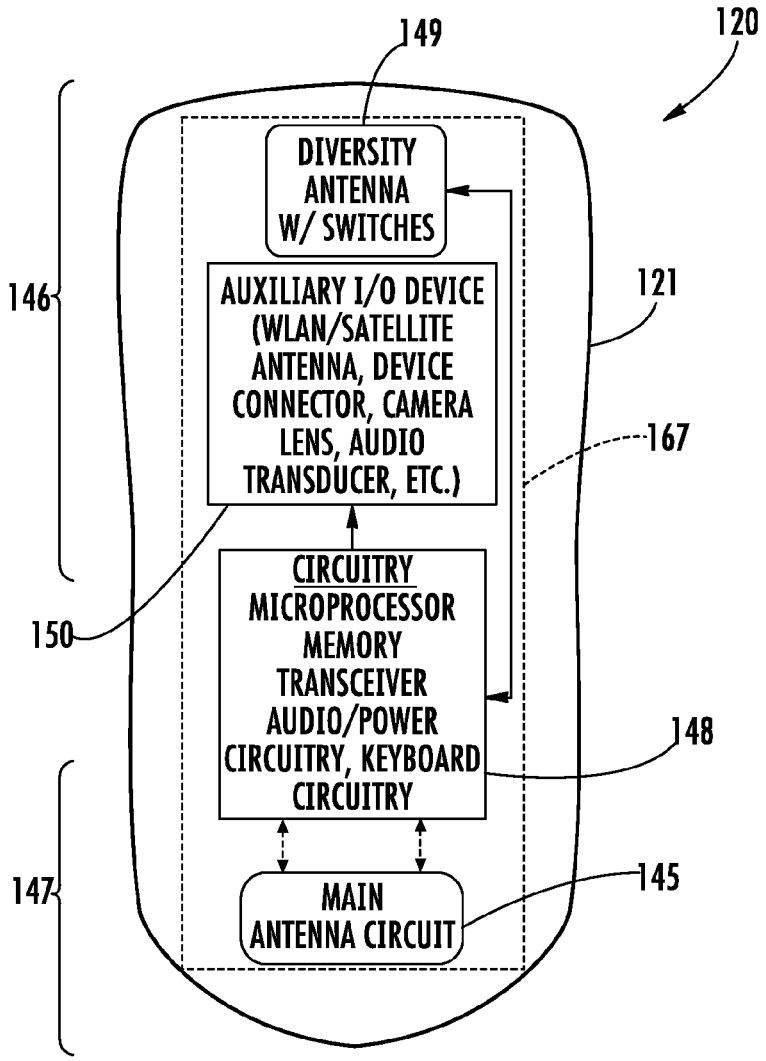
FIG. 5 is a schematic block diagram of an example of a mobile wireless communications device configured as a handheld device that can be used in accordance with non-limiting examples and illustrating basic internal components.
Figure 6:
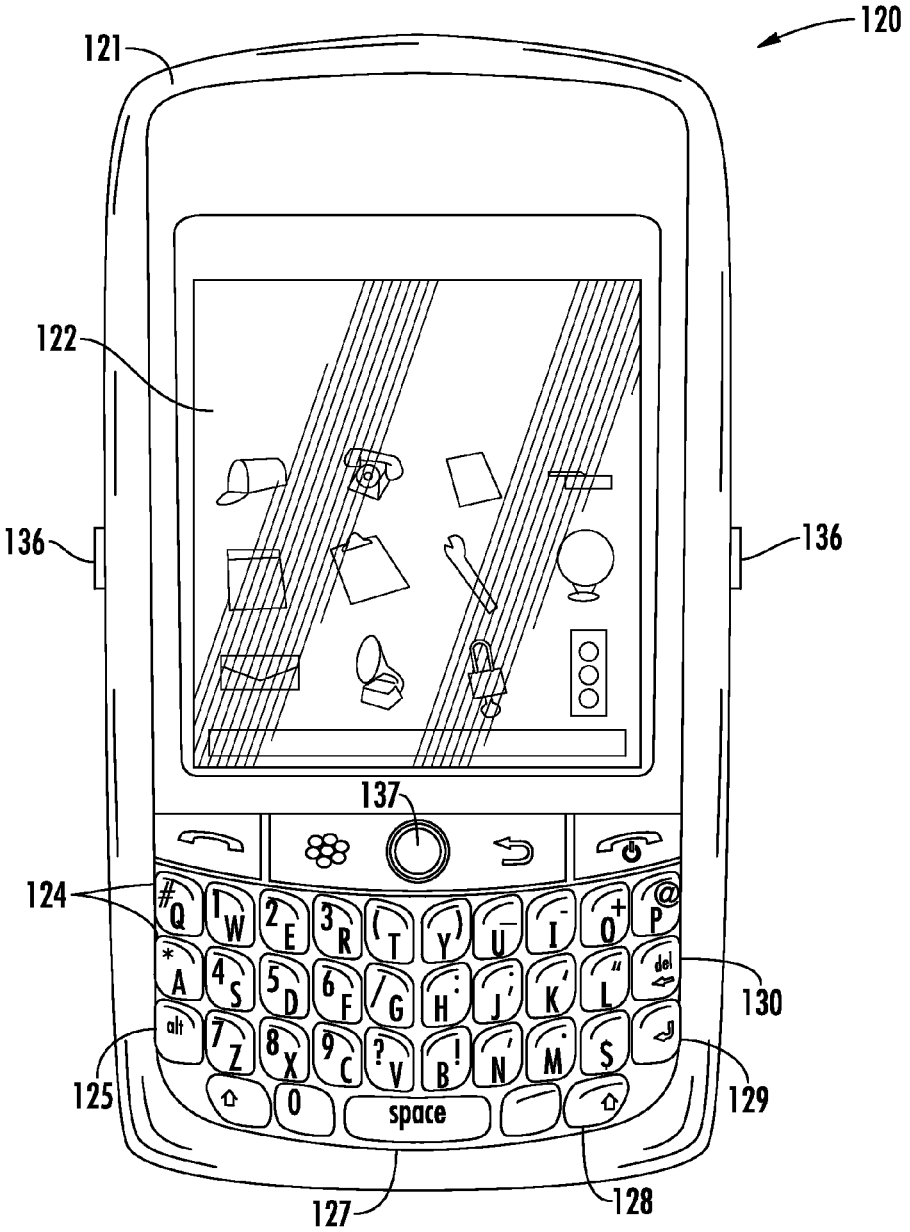
FIG. 6 is a front elevation view of the mobile wireless communications device of FIG. 5.
Figure 7:
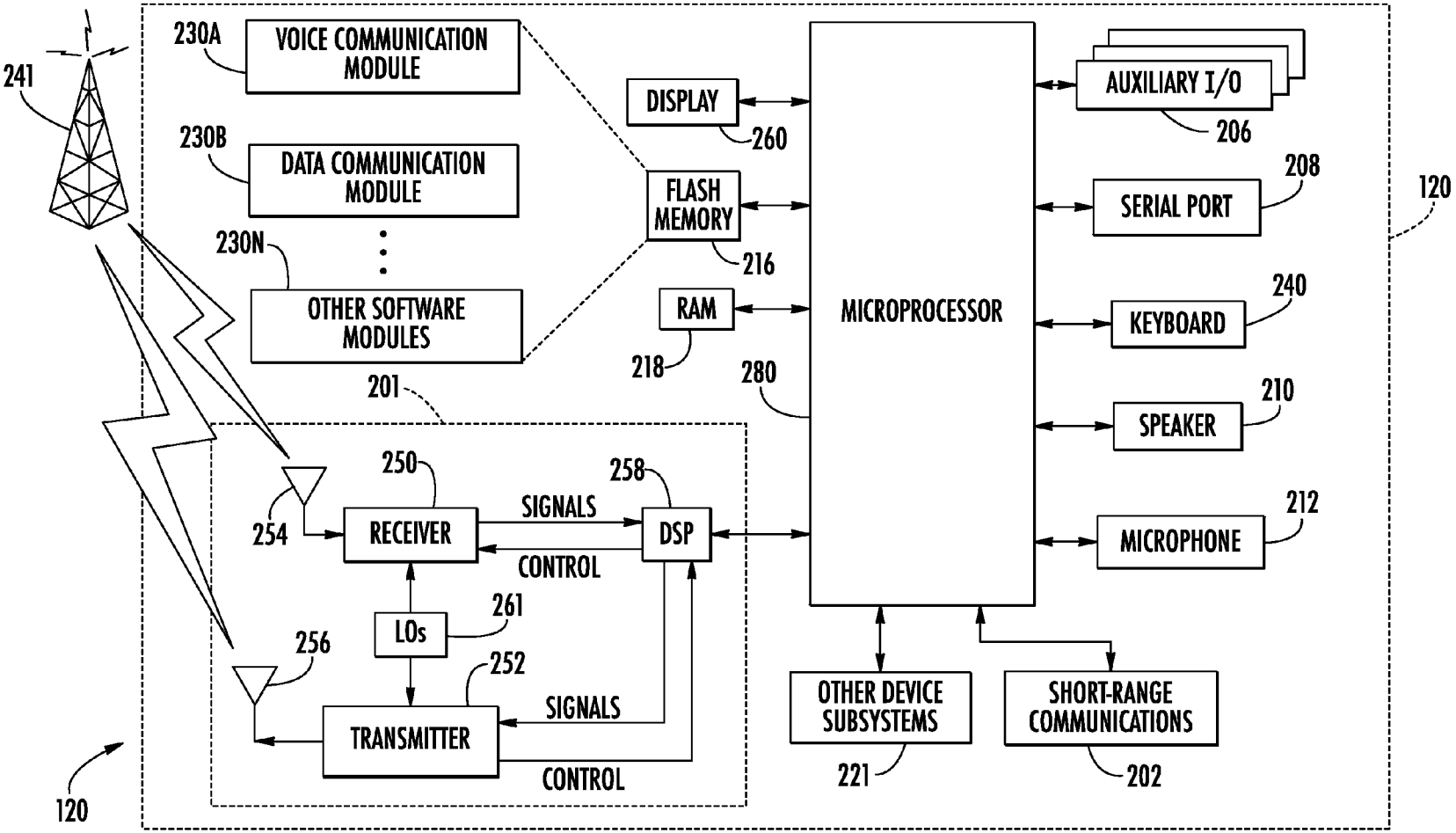
FIG. 7 is a schematic block diagram showing basic functional circuit components that can be used in the mobile wireless communications device of FIGS. 1-6 as described.

A brief description will now proceed relative to FIGS. 5-7, which disclose an example of a mobile wireless communications device, for example, a handheld portable cellular radio, which can incorporate as non-limiting examples the various circuits that can be used with the main antenna 22 and diversity antenna 34 as described above. FIGS. 5-7 are representative non-limiting examples of the many different types of functional circuit components and their interconnection, and operative for use with the main and diversity antennae 22, 34.

Referring now to FIG. 5, an example of a mobile wireless communications device 120, such as a handheld portable cellular radio is described as an example mobile wireless communications device that can be used. This device 120 illustratively includes a housing 121 having an upper portion 146 and a lower portion 147, and a dielectric substrate (i.e., circuit board) 167, such as a conventional printed circuit board (PCB) substrate, for example, carried by the housing. A housing cover (not shown in detail) would typically cover the front portion of the housing. The term circuit board 167 as used hereinafter can refer to any dielectric substrate, PCB, ceramic substrate or other circuit carrying structure for carrying signal circuits and electronic components within the mobile wireless communications device 120. The illustrated housing 121 is a static housing, for example, as opposed to a flip or sliding housing, which is used in many cellular telephones. However, these and other housing configurations may also be used. In this example, the circuit board 167 is about the same size as the housing 121, and thus, a cable connecting the diversity antenna and switches 149 and main antenna 145 is not used.

Circuitry 148 is carried by the circuit board 167, such as a microprocessor, memory, one or more wireless transceivers (e.g., cellular, WLAN, etc.), which includes RF circuitry, including audio and power circuitry, including any keyboard circuitry. It should be understood that keyboard circuitry could be on a separate keyboard, etc., as will be appreciated by those skilled in the art. A battery (not shown) is also preferably carried by the housing 121 for supplying power to the circuitry 148. The term RF circuitry could encompass the interoperable RF transceiver circuitry, power circuitry and audio circuitry. The circuit board carries the main antenna 145 at the lower end of the housing and diversity antenna 149 at the upper end of the housing in this non-limiting example, similar to that shown in FIG. 1. In this example, the diversity antenna 149 is an adaptive array antenna and is connected to the main antenna 145 through appropriate circuit traces, for example, contained on the circuit board and operates through the various components, including the microprocessor for controlling the switches and antenna components for the diversity antenna. The diversity antenna 149 in this example could be formed from individual antenna elements, each equipped with a switch such as shown in the example of FIG. 2.

Furthermore, an audio output transducer (e.g., a speaker) is carried by an upper portion 146 of the housing 121 and connected to the circuitry 148. One or more user input interface devices, such as a keypad (keyboard) 123 (FIG. 6), is also preferably carried by the housing 121 and connected to the circuitry 148. The term keypad 123 as used herein also refers to the term keyboard, indicating the user input devices having lettered and/or numbered keys commonly known and other embodiments, including multi-top or predictive entry modes. Other examples of user input interface devices include a track ball 137 and convenience keys 136, which could be positioned on the left and right sides of the housing. Of course, it will be appreciated that other user input interface devices (e.g., a stylus or touch screen interface) may be used in other embodiments. Also, other input interface devices could be used, for example, a mute/standby key, volume key or other menu. The housing could incorporate headset pads, USB ports, media card slots and other similar keys or inputs.

The main (or cellular) antenna 145, for example, a GSM antenna, is preferably positioned at the lower portion 147 in the housing (FIG. 5) and can be formed as a pattern of conductive traces that make an antenna circuit, which physically forms the antenna. Other antenna configurations can be used as non-limiting examples. This main antenna 145 is connected to the circuitry 148 on the main circuit board 167. In one non-limiting example, the main antenna 145 could be formed on an antenna circuit board that extends from the main circuit board at the lower portion of the housing. Also, a separate keyboard circuit board could be used. Of course, any separate antenna board in some cases could be used for each antenna, such as the main antenna and the diversity antenna 149, or both placed on a separate board and separated from each other. Other components could be placed on separate boards, for example, any transducers such as speakers and microphones could be mounted on separate boards. The diversity antenna 149 is located away from the main antenna 145 in this example, thus positioning the main antenna 145 at the bottom of the housing and the diversity antenna 149 at the top of the housing.

More particularly, a user will typically hold the upper portion of the housing 121 very close to his head so that any audio output transducer is directly next to his ear. Yet, the lower portion 147 of the housing 121 where an audio input transducer (i.e., microphone) is located need not be placed directly next to a user's mouth, and can be held away from the user's mouth. That is, holding the audio input transducer close to the user's mouth may not only be uncomfortable for the user, but it may also distort the user's voice in some circumstances.

Another important benefit of placing the main antenna 145 adjacent the lower portion 147 of the housing 121 is that this may allow for less impact on antenna performance due to blockage by a user's hand. Users typically hold phones toward the middle to upper portion of the phone housing, and are therefore more likely to put their hands over such an antenna than they are an antenna mounted adjacent the lower portion 147 of the housing 121. Accordingly, more reliable performance may be achieved by placing the main antenna 145 adjacent the lower portion 147 of the housing 121.

Still another benefit of this configuration is that it provides more room for one or more auxiliary input/output (I/O) devices 150 to be carried at the upper portion 146 of the housing. Furthermore, by separating the main antenna 145 from the auxiliary I/O device(s) 150, this may allow for reduced interference therebetween.

Examples of auxiliary I/O devices 150 could include another antenna besides a diversity antenna, such as a WiFi or WLAN (e.g., Bluetooth, IEEE 802.11) antenna for providing WLAN communication capabilities and/or a satellite positioning system (e.g., GPS, Galileo, etc.) antenna for providing position location capabilities, as will be appreciated by those skilled in the art. Other examples of auxiliary I/O devices 150 include a second audio output transducer (e.g., a speaker for speaker phone operation), and a camera lens for providing digital camera capabilities, an electrical device connector (e.g., USB, headphone, secure digital (SD) or memory card, etc.).

It should be noted that the term "input/output" as used herein for the auxiliary I/O device(s) 150 means that such devices may have input and/or output capabilities, and they need not provide both in all embodiments. That is, devices such as camera lenses may only receive an optical input, for example, while a headphone jack may only provide an audio output.

The device 120 further illustratively includes a display 122 (FIG. 6), for example, a liquid crystal display (LCD) carried by the housing 121 and connected to the circuitry 148 (FIG. 5). Convenience keys 136 and track ball 137 can also be connected to the circuitry 148 for allowing a user to navigate menus, text, etc., as will be appreciated by those skilled in the art. The track ball 137 may also be referred to as a "thumb wheel" or a "track wheel" in some instances and positioned in different locations. The keypad 123 illustratively includes a plurality of multi-symbol keys 124 each having indicia of a plurality of respective symbols thereon. The keypad 123 also illustratively includes an alternate function key 125, a space key 127, a shift key 128, a return (or enter) key 129, and a backspace/delete key 130.

Some keys could also be used to enter a "*" symbol upon first pressing or actuating the alternate function key 125. Similarly, the space key 127, shift key 128 and backspace key 130 could be used to enter a "0" and "#", respectively, upon first actuating the alternate function key 125 in some examples. The keypad 123 could include an escape key, an end or power key, and a convenience (i.e., menu) key for use in accessing an expanded home screen and placing cellular telephone calls. Many of these keys can be located in different positions.

Moreover, the symbols on each key 124 are arranged in top and bottom rows. The symbols in the bottom rows are entered when a user presses a key 124 without first pressing the alternate function key 125, while the top row symbols are entered by first pressing the alternate function key in this example keyboard. As seen in FIG. 6, the multi-symbol keys 124 are arranged in the rows on the keypad 123. Furthermore, the letter symbols on each of the keys 124 are arranged to define a QWERTY layout. That is, the letters on the keypad 123 are presented in a three-row format, with the letters of each row being in the same order and relative position as in a standard QWERTY keypad. Each row of keys can be arranged in columns.

Accordingly, the mobile wireless communications device 120 as described may advantageously be used not only as a traditional cellular phone, but it may also be conveniently used for sending and/or receiving data over a cellular or other network, such as Internet and email data, for example. Of course, other keypad configurations may also be used in other embodiments. Multi-tap or predictive entry modes may be used for typing e-mails, etc. as will be appreciated by those skilled in the art.

The main antenna 145 and diversity antenna 149 operate together as a multi-frequency band antenna system, which provides enhanced transmission and reception characteristics over multiple operating frequencies. More particularly, the antennae are designed to provide high gain, desired impedance matching, and meet applicable SAR requirements over a relatively wide bandwidth and multiple frequency bands such as different cellular frequency bands. For example, the antennae can operate over five bands, for example, a 850 MHz Global System for Mobile Communications (GSM) band (GSM 850), a 900 MHz GSM band, a DCS band, a PCS band, and a WCDMA band (i.e., up to about 2100 MHz) (or CDMA 850/1900), although it may be used for other bands/frequencies as well as noted above. To conserve space, the main antenna 145 may advantageously be implemented in three dimensions although it may be implemented in two-dimensional or planar embodiments as well.

The mobile wireless communications device shown in FIGS. 5 and 6 can incorporate e-mail and messaging accounts and provide different functions such as composing e-mail, PIN messages, and SMS messages. The device can manage messages through an appropriate menu that can be retrieved by choosing a messages icon. An address book function could add contacts, allow management of an address book, set address book options and manage SIM card phone books. A phone menu could allow for the making and answering of phone calls using different phone features, managing phone call logs, setting phone options, and viewing phone information. A browser application could permit the browsing of web pages, configuring a browser, adding bookmarks, and changing browser options. Other applications could include a task, memo pad, calculator, alarm and games, as well as handheld options with various references.

A calendar icon can be chosen for entering a calendar program that can be used for establishing and managing events such as meetings or appointments. The calendar program could be any type of messaging or appointment/meeting program that allows an organizer to establish an event, for example, an appointment or meeting.

A non-limiting example of various functional components that can be used in the exemplary mobile wireless communications device 120 of FIGS. 1-6 is further described in the example below with reference to FIG. 7. The device 120 illustratively includes a housing 220, a keypad 240 and an output device 260. The output device 260 shown is preferably a display, which is preferably a full graphic LCD. Other types of output devices may alternatively be used. A processing device 280 is contained within the housing 220 and is coupled between the keypad 240 and the display 260. The processing device 280 controls the operation of the display 260, as well as the overall operation of the mobile device 120, in response to actuation of keys on the keypad 240 by the user.

The housing 220 may be elongated vertically, or may take on other sizes and shapes (including clamshell housing structures). The keypad may include a mode selection key, or other hardware or software for switching between text entry and telephony entry.

In addition to the processing device 280, other parts of the mobile device 120 are shown schematically in FIG. 7, These include a communications subsystem 201; a short-range communications subsystem 202; the keypad 240 and the display 260, along with other input/output devices 206, 208, 210 and 212; as well as memory devices 216, 218 and various other device subsystems 221. The mobile device 120 is preferably a two-way RF communications device having voice and data communications capabilities. In addition, the mobile device 120 preferably has the capability to communicate with other computer systems via the Internet.

Operating system software executed by the processing device 280 is preferably stored in a persistent store, such as the flash memory 216, but may be stored in other types of memory devices, such as a read only memory (ROM) or similar storage element. In addition, system software, specific device applications, or parts thereof, may be temporarily loaded into a volatile store, such as the random access memory (RAM) 218. Communications signals received by the mobile device may also be stored in the RAM 218.

The processing device 280, in addition to its operating system functions, enables execution of software applications 230A-230N on the device 120. A predetermined set of applications that control basic device operations, such as data and voice communications 230A and 230B, may be installed on the device 120 during manufacture. In addition, a personal information manager (PIM) application may be installed during manufacture. The PIM is preferably capable of organizing and managing data items, such as e-mail, calendar events, voice mails, appointments, and task items. The PIM application is also preferably capable of sending and receiving data items via a wireless network 241. Preferably, the PIM data items are seamlessly integrated, synchronized and updated via the wireless network 241 with the device user's corresponding data items stored or associated with a host computer system.

Communication functions, including data and voice communications, are performed through the communications subsystem 201, and possibly through the short-range communications subsystem. The communications subsystem 201 includes a receiver 250, a transmitter 252, and one or more antennae 254 and 256. In addition, the communications subsystem 201 also includes a processing module, such as a digital signal processor (DSP) 258, and local oscillators (LOs) 261. The specific design and implementation of the communications subsystem 201 is dependent upon the communications network in which the mobile device 120 is intended to operate. For example, the mobile device 120 may include a communications subsystem 201 designed to operate with the Mobitex™, Data TAC™ or General Packet Radio Service (GPRS) mobile data communications networks, and also designed to operate with any of a variety of voice communications networks, such as AMPS, TDMA, CDMA, PCS, GSM, etc. Other types of data and voice networks, both separate and integrated, may also be utilized with the mobile device 120.

Network access requirements vary depending upon the type of communication system. For example, in the Mobitex and DataTAC networks, mobile devices are registered on the network using a unique personal identification number or PIN associated with each device. In GPRS networks, however, network access is associated with a subscriber or user of a device. A GPRS device therefore requires a subscriber identity module, commonly referred to as a SIM card, in order to operate on a GPRS network.

When required network registration or activation procedures have been completed, the mobile device 120 may send and receive communications signals over the communication network 241. Signals received from the communications network 241 by the antenna 254 are routed to the receiver 250, which provides for signal amplification, frequency down conversion, filtering, channel selection, etc., and may also provide analog to digital conversion. Analog-to-digital conversion of the received signal allows the DSP 258 to perform more complex communications functions, such as demodulation and decoding. In a similar manner, signals to be transmitted to the network 241 are processed (e.g., modulated and encoded) by the DSP 258 and are then provided to the transmitter 252 for digital to analog conversion, frequency up conversion, filtering, amplification and transmission to the communication network 241 (or networks) via the antenna 256.

In addition to processing communications signals, the DSP 258 provides for control of the receiver 250 and the transmitter 252. For example, gains applied to communications signals in the receiver 250 and transmitter 252 may be adaptively controlled through automatic gain control algorithms implemented in the DSP 258.

In a data communications mode, a received signal, such as a text message or web page download, is processed by the communications subsystem 201 and is input to the processing device 280. The received signal is then further processed by the processing device 280 for an output to the display 260, or alternatively to some other auxiliary I/O device 206. A device user may also compose data items, such as e-mail messages, using the keypad 240 and/or some other auxiliary I/O device 206, such as a touchpad, a rocker switch, a thumb-wheel, or some other type of input device. The composed data items may then be transmitted over the communications network 241 via the communications subsystem 201.

In a voice communications mode, overall operation of the device is substantially similar to the data communications mode, except that received signals are output to a speaker 210, and signals for transmission are generated by a microphone 212. Alternative voice or audio I/O subsystems, such as a voice message recording subsystem, may also be implemented on the device 120. In addition, the display 260 may also be utilized in voice communications mode, for example to display the identity of a calling party, the duration of a voice call, or other voice call related information.

Any short-range communications subsystem enables communication between the mobile device 120 and other proximate systems or devices, which need not necessarily be similar devices. For example, the short-range communications subsystem may include an infrared device and associated circuits and components, or a Bluetooth™ communications module to provide for communication with similarly-enabled systems and devices.

It should be understood that GSM is one type of preferred communications system and uses a radio interface that can have an uplink frequency band and downlink frequency band with about 25 MHz bandwidth, typically subdivided into 124 carrier frequency channels, each spaced about 200 KHz apart as non-limiting examples. Time division multiplexing can be used to allow about 8 speech channels per radio frequency channel, giving 8 radio time slots and 8 burst periods grouped into what is called a TDMA frame. For example, a channel data rate could be about 270.833 Kbps and a frame duration of about 4.615 milliseconds (MS) in one non-limiting example. The power output can vary from about 1 to about 2 watts.

Linear predictive coding (LPC) can also be used to reduce the bit rate and provide parameters for a filter to mimic a vocal track with speech encoded at about 13 Kbps. Four different cell sizes can be used in a GSM network, including macro, micro, pica and umbrella cells. A base station antenna can be installed on a master building above the average rooftop level in a macrocell. In a macrocell, the antenna height can be under the average rooftop level and used in urban areas. Microcells typically have a diameter of about a few dozen meters and are used indoors. Umbrella cells can cover shadowed regions or smaller cells. Typically, the longest distance for the GSM specification covered by an antenna is about 22 miles depending on antenna height, gain and propagation conditions.

GSM systems typically include a base station subsystem, a network and switching subsystem, and a General Packet Radio Service (GPRS) core network. A subscriber identify module (SIM) is usually implemented in the communications device, for example, the well known SIM card, similar to a smart card containing the subscription information and phone book of a user. The user can also switch handsets or could change operators by changing a SIM.

The GSM signaling protocol has three general layers. Layer 1 is a physical layer using channel structures above the air interface. Layer 2 is the data link layer. Layer 3 is a signaling protocol, which includes three sublayers. These include a Radio Resources Management sublayer to control the setup, maintenance and termination of radio and fixed channels, including handovers. A Mobility Management sublayer manages the location updating and registration procedures and secures the authentication. A Connection Management sublayer handles general call control and manages supplementary services and the short message service. Signaling between different entities such as the Home Location Register (HLR) and Visiting Location Register (VLR) can be accomplished through a Mobile Application Part (MAP) built upon the Transaction Capabilities Application Part (TCAP) of the top layer of the Signaling System No. 7.

A Radio Resources Management (RRM) sublayer can oversee the radio and fixed link establishment between the mobile station and an MSE.

It is also possible to used Enhanced Data Rates for GSM Evolution (EDGE), as an enhancement to General Packet Radio Service (GPRS) networks. EDGE can use 8 Phase Shift Keying (8 PSK) and Gaussian Minimum Shift Keying (GMSK) for different modulation and coding schemes. A three-bit word can be produced for every changing carrier phase. A rate adaptation algorithm can adapt the Modulation and Coding Scheme (MCS) according to the quality of the radio channel and the bit rate and robustness of data transmission. Base stations are typically modified for EDGE use.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A mobile wireless communications device comprising:
a diversity antenna and a main antenna; and
RF circuitry configured to
tune the diversity antenna into a diversity communications frequency band for a diversity mode of operation with the main antenna, and
place the diversity antenna in an open circuit condition based upon cross-coupling between the diversity antenna and the main antenna when operating in the diversity communications frequency band, said RF circuitry comprising at least one switch coupled to said diversity antenna for placing said diversity antenna in the open circuit condition.

2. The mobile wireless communications device according to claim 1, and further comprising a housing having upper and lower portions; and wherein the diversity antenna is located at the upper portion of the housing and the main antenna is located at the lower portion of the housing.

3. The mobile wireless communications device according to claim 1, wherein the diversity antenna comprises an array antenna comprising a plurality of antenna elements.

4. The mobile wireless communications device according to claim 3, wherein the at least one switch comprises a respective switch coupled to each antenna element to change a combined radiation pattern of the array antenna.

5. The mobile wireless communications device according to claim 4, wherein each switch comprises a microelectromechanical (MEMS) switch.

6. The mobile wireless communications device according to claim 1, further comprising a circuit board carrying the RF circuitry.

7. The mobile wireless communications device according to claim 6, further comprising a cable coupled to the diversity antenna and circuit board and operative with the main antenna.

8. The mobile wireless communications device according to claim 1, further comprising at least one load switchable to the RF circuitry.

9. The mobile wireless communications device according to claim 1, wherein the main antenna is operative at frequencies in the Global System for Mobile (GSM) frequency communications band.

10. A mobile wireless communications device comprising:
a housing;
a diversity antenna and a main antenna carried by said housing in spaced apart relation; and
RF circuitry carried by the housing and configured to
tune the diversity antenna into a diversity communications frequency band for a diversity mode of operation with the main antenna, and
place the diversity antenna in an open circuit condition based upon cross-coupling between the diversity antenna and the main antenna when operating in the diversity communications frequency band, said RF circuitry comprising at least one switch coupled to said diversity antenna for placing said diversity antenna in the open circuit condition.

11. The mobile wireless communications device according to claim 10, wherein the housing has upper and lower portions; and wherein the diversity antenna is located at the upper portion of the housing and the main antenna is located at the lower portion of the housing.

12. The mobile wireless communications device according to claim 10, wherein the diversity antenna comprises an array antenna comprising a plurality of antenna elements.

13. The mobile wireless communications device according to claim 12, wherein the at least one switch comprises a respective switch coupled to each antenna element to change a combined radiation pattern of the array antenna.

14. The mobile wireless communications device according to claim 13, wherein each switch comprises a microelectromechanical (MEMS) switch.

15. The mobile wireless communications device according to claim 10, further comprising a circuit board carrying the RF circuitry.

16. The mobile wireless communications device according to claim 15, further comprising a cable coupled to the diversity antenna and circuit board and operative with the main antenna.

17. The mobile wireless communications device according to claim 10, further comprising at least one load switchable to the RF circuitry.

18. The mobile wireless communications device according to claim 10, wherein the main antenna is operative at frequencies in the Global System for Mobile (GSM) frequency communications band.

19. A method of operating a mobile wireless communications device comprising a diversity antenna, a main antenna, and RF circuitry coupled to the diversity and main antennas, the method comprising:

tune the diversity antenna into a diversity communications frequency band for a diversity mode of operation with the main antenna; and place the diversity antenna in an open circuit condition based upon cross-coupling between the diversity antenna and the main antenna when operating in the diversity communications frequency band, the RF circuitry comprising at least one switch coupled to the diversity antenna for placing the diversity antenna in the open circuit condition.

20. The method according to claim 19, wherein the mobile wireless communications device comprises a housing having upper and lower portions; and wherein the diversity antenna is located at the upper portion of the housing and the main antenna is located at the lower portion of the housing.

21. The method according to claim 19, wherein the diversity antenna comprises an array antenna comprising a plurality of antenna elements; and further comprising operating the RF circuitry to change a combined radiation pattern of the array antenna.

22. The method according to claim 19, further comprising switching at least one load to the RF circuitry.

23. The method according to claim 19, wherein the main antenna is operative at frequencies in the Global System for Mobile (GSM) frequency communications band.

* * * * *